United States Patent [19]

Cook, II et al.

[11] Patent Number: 5,034,663

[45] Date of Patent: Jul. 23, 1991

[54] POWER SOURCE FOR METAL HALIDE LAMPS AND THE LIKE

[75] Inventors: James C. Cook, II; Larry Eccleston, both of Marshall, Mich.

[73] Assignee: Progressive Dynamics, Inc., Marshall, Mich.

[21] Appl. No.: 341,573

[22] Filed: Apr. 21, 1989

[51] Int. Cl.[5] ..... H05B 41/36

[52] U.S. Cl. ..... 315/308; 315/307; 315/219

[58] Field of Search ..... 315/307, 308, 291, DIG. 7, 315/226, 209 T, 299, 301, 219

[56] References Cited

U.S. PATENT DOCUMENTS

| | | | |
|---|---|---|---|
| 3,689,827 | 9/1972 | Quinn | 315/308 X |
| 4,240,009 | 12/1980 | Paul | 315/308 X |
| 4,289,993 | 9/1981 | Harper et al. | 315/308 X |
| 4,698,554 | 10/1987 | Stupp et al. | 315/307 |

*Primary Examiner*—Eugene R. LaRoche
*Assistant Examiner*—Ali Neyzari
*Attorney, Agent, or Firm*—Price, Heneveld Cooper, DeWitt & Litton

[57] ABSTRACT

A power supply for a gas discharge lamp includes a current regulator for regulating the current supplied to a lamp and current steering means for steering current from the current regulator in alternating directions through an isolation transformer primary winding, the secondary winding of the transformer being connected with a lamp through an arc striking circuit. The frequency of alternating the current through the transformer is controlled as a function of the lamp voltage in order to regulate the volt-second product of the transformer through all portions of a lamp operating cycle including arc striking. This reduces saturation of the transformer and allows a much smaller transformer to be used. In a preferred embodiment, the current regulation and steering functions are performed in a bridge circuit having FET switches in each leg and in which the transformer primary spans the sides of the bridge. Pairs of FETs in diametrically opposite legs of the bridge are operated in unison, with one FET of each pair controlling lamp current by pulse-width regulation. The current is steered through the transformer primary by alternatingly operating the FET pairs at a frequency established by a voltage-controlled oscillator responsive to transformer voltage.

17 Claims, 3 Drawing Sheets

POWER SOURCE FOR METAL HALIDE LAMPS AND THE LIKE

BACKGROUND OF THE INVENTION

This invention relates to power supplies for gas discharge lamps and in particular to high intensity gas discharge lamps such as metal halide lamps.

High wattage, high intensity metal halide lamps are desirable because of their natural color output and find application as a light source for fiber optic surgical inspection devices and stage lighting. One difficulty with high intensity metal halide lamps is that their lamp life is short, typically under 100 hours. In order to preserve lamp life, it is desirable to apply constant wattage to the lamp. This is a somewhat complicated task because the natural impedance of the lamp changes over its lifetime so that a constant current or a constant voltage source alone are not optimal for providing maximum lifetime.

Another characteristic of metal halide lamps is the very high voltage required to strike an arc in the lamp. Even utilizing a voltage multiplying circuit to establish an arc, the conventional power supply must supply such a striker circuit with a nominal 300 volts to establish the arc. The voltage from the power supply is multiplied by the striker circuit to typically 30,000 volts. Once the arc is struck, however, the lamp operates as a voltage regulator, establishing a 40 to 80 volt drop across its terminals and, therefore, requires a reduced voltage from the power supply. One common failure mode for a power supply for such a lamp is high voltage breakdown to chassis ground during the arc striking phase. An isolation transformer between the power supply and striker circuit will greatly reduce the likelihood of such a failure. However, an isolation transformer that is capable of providing the necessary 300 volt supply during striking, without saturating the transformer, is large and bulky compared with the size of the transformer required to operate the lamp at 40 to 80 volts after the arc has been struck.

An additional consideration in providing a power supply for a high intensity metal halide lamp is that, due to their relatively short lifetime, such lamps are typically switched off and on frequently to maximize their longevity. Conventional power supplies utilize an input thermistor to limit the in-rush current upon initial startup. The thermistor has a higher "cold" resistance value, which decreases as the thermistor heats up. If such a supply is switched off and back on again in a relatively short cycle, such as one second, the thermistor will not have had an opportunity to cool sufficiently to reestablish a high resistance. To handle such circumstance, a conventional supply is fused at a higher than desirable level.

SUMMARY OF THE INVENTION

It is an object of the invention to overcome the difficulties of the prior art and provide a power supply for a gas discharge lamp such as a metal halide lamp that provides transformer isolation to the lamp without requiring an oversized transformer in order to avoid saturation. It is a further object of the invention to prolong lamp lifetime by providing such a power supply that is capable of maintaining a constant power to the lamp notwithstanding changes in the lamp characteristics with age. These and other objects are met by a power supply for a gas discharge lamp, which includes a DC power source, a transformer having a primary winding and a secondary winding, the secondary winding being adapted to supply power to a discharge lamp. Current regulation and steering means are provided for regulating the current supplied to the discharge lamp from the power source and for steering the regulated current through the transformer primary winding in alternating directions in response to the voltage supplied across the transformer windings so as to maintain a predetermined volt-second product across the transformer windings. In this manner, the voltage applied to the lamp may be substantially increased during lamp ignition, without causing the transformer to saturate and the size of the transformer required is substantially reduced. According to another aspect of the invention, the current may be regulated as a function of the product of the current supplied to the lamp and the voltage across the lamp in order to maintain a constant power level to the lamp.

In a preferred embodiment, a current regulation means includes a constant frequency oscillator and a pulse-width modulation circuit which is responsive to the product of the current to the lamp and the voltage across the lamp to modulate the width of the pulses to regulate the current to the lamp as a function of the power provided to the lamp. Current steering means are provided to direct current regulated by the regulating means in alternating directions through the transformer primary windings at a variable frequency in response to the voltage across the transformer windings. The constant frequency oscillator is operated at a much higher frequency than the range of frequencies of the current steering means. In a most preferred embodiment, four switching devices, such as power, field effect transistors (FETs) are arranged in a bridge circuit with a series connected inductor and transformer primary spanning the bridge. Current regulating FETs are positioned in two adjacent legs of the bridge on one side of the spanning circuit and current steering FETs in adjacent legs of the bridge on the opposite side of the spanning circuit. Diametrically opposite FETs are operated in pairs, with one FET of each pair operating in a fixed frequency switch-mode for current regulation and the other FET of each pair alternating with its counterpart at a frequency established by a transformer-voltage-responsive variable frequency oscillator to alternate current through the transformer primary in a manner that is directed toward maintaining a constant volt-second product at the transformer. These and other related objects, advantages and features of this invention will become apparent upon review of the following specification in conjunction with the drawings.

DESCRIPTION OF THE PREFERRED EMBODIMENT

Figure 1:
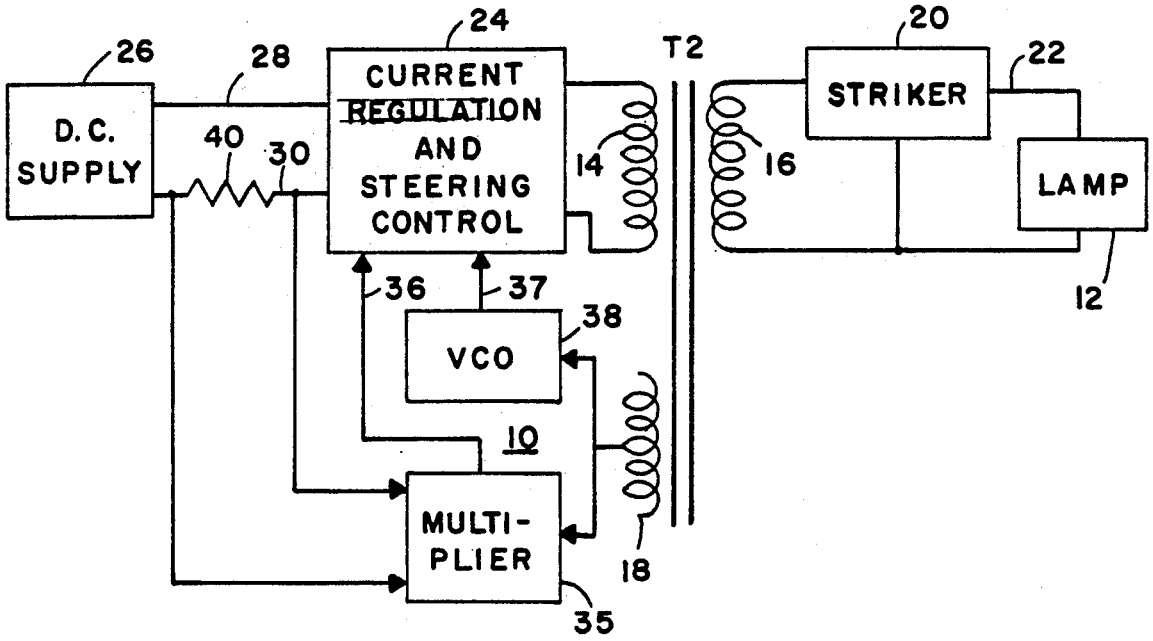
FIG. 1 is a diagram of a circuit embodying the invention illustrated in block diagram form.

Referring now specifically to the drawings, and the illustrative embodiments depicted therein, a power source 10 for a metal halide lamp 12 includes an isolation transformer T2 having a primary winding 14, a secondary winding 16 and a monitor winding 18. Primary and secondary windings 14 and 16 have a 1:1 turns ratio. Lamp 12 is connected with secondary winding 16 through a striker circuit 20 which establishes a very high voltage, such as 30,000 volts, on its output 22 during the startup of lamp 12 in order to establish an arc through the lamp. At all other times, striker circuit 20 is intended to respond as a direct connection between secondary winding 16 and its output 22. In a preferred embodiment, striker circuit 20 is a series-injection-trigger circuit, of the type known in the art, but may be of other conventional configuration.

Power source 10 further includes a current regulation and steering control circuit 24 which is supplied from a DC power supply 26 through lines 28 and 30 and provides a current regulated squarewave, having a frequency or pulse repetition rate that varies between 250 and 1400 Hz, to primary winding 14 of transformer T2. A voltage controlled oscillator 38 produces a variable frequency signal on a line 37 to circuit 24 that is proportional to the average rectified AC voltage across monitor winding 18. The output frequency of circuit 24 is established by the voltage level on line 38. A multiplier circuit 35 monitors the voltage across a monitoring resistor 40 in series with circuit 24, which is proportional to the current therethrough, and produces a DC voltage on line 36 that is a function at least of the voltage across resistor 40. Circuit 24 responds to the voltage level on line 36 to regulate the current supplied to primary winding 14 of transformer T2, which is proportional to the current ultimately provided to lamp 12. In a most preferred embodiment, the voltage produced on line 36, and hence the current supplied to lamp 12, is also a function of the average voltage across monitor winding 18 and is proportional to the multiplication product of the current monitored at resistor 40 and the voltage monitored at monitor winding 18. In the most preferred embodiment, the signal on line 36 is thus proportional to the power that is supplied to lamp 12. Although the voltage across the lamp is not monitored directly, it will be substantially the same as that across secondary winding 16 except during arc striking, because once an arc is struck, the striker circuit drops out of the power supply 10. In this manner, current regulation and steering control circuit 24 regulates current supplied to lamp 12 in a manner that maintains a constant power to lamp 12 and a constant volt-second product across transformer T2.

Figure 5:
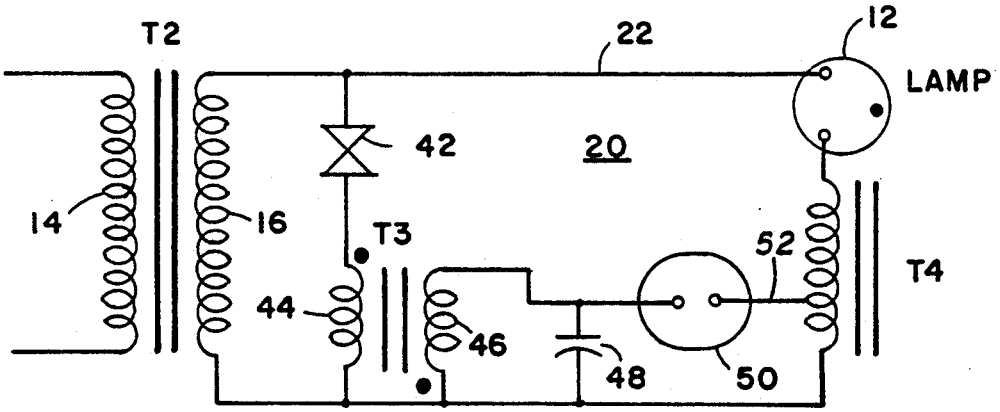
FIG. 5 is a circuit diagram of a lamp arc striker circuit in schematic diagram form.

To provide a better understanding of the illustrated embodiment, the operation of striker circuit 20 will be described, although as previously stated, the operation of striker circuit 20 per se is known in the art and other striker circuits may be used. With reference to FIG. 5 striker circuit 20 includes a voltage breakover device, or SIDAC, 42 in series with a primary winding 44 of a step-up transformer T3 having a ratio of 1:10. The secondary winding 46 of T3 is connected in parallel with a capacitor 48 and in series through a spark gap device 50 to the input tap 52 of an auto-transformer T4. The remaining portion of the winding of transformer T4 is in series with lamp 12 and secondary winding 16 of T2. In order to strike an arc across lamp 12, it is necessary to provide approximately 30,000 volts across the lamp. This is accomplished by momentarily providing 300 volts across secondary winding 16 of T2. SIDAC 42 responds to the 300 volts by conducting, which causes transformer T3 to step-up the voltage to 3,000 volts on its secondary 46. This voltage causes spark gap 50 to discharge or conduct, which applies 3,000 volts to auto-transformer T4, which in turn, steps up the voltage to 30,000 volts. Lamp 12 will respond to this high voltage by establishing an arc therethrough and once the arc is established in lamp 12, the lamp performs as a voltage regulator. Depending upon the individual characteristics, lamp 12 will establish a voltage across its terminals of between 40 and 80 volts during its operating phase. Lamp 12, acting as a voltage regulator, will reduce the voltage demand across secondary 16 to between 40 and 80 volts which will cause SIDAC 42 to terminate conducting, which also prevents the remaining components of striker circuit 20 from operating.

Thus it is seen that in order to properly start and operate lamp 12, power source 10 must be capable of momentarily producing a relatively high voltage, such as 300 volts, across secondary winding 16 until an arc is struck in lamp 12 and subsequently supplying a relatively low voltage, such as between 40 and 80 volts, across secondary winding 16. While it would be feasible to accommodate these ranges of voltages, without saturating transformer T2, by sizing transformer T2 to the largest anticipated voltage to be provided across secondary 16 power source 10 instead allows the use of a much smaller transformer T2 by regulating the volt-second product applied to transformer T2. This is accomplished by monitoring the voltage applied to transformer T2, by monitor winding 18. Voltage control oscillator (VCO) 38 responds to the voltage on monitor winding 18 by causing current regulator and current steering control circuit 24 to alternate the direction of current through primary winding 14 at a rate that is proportional to the voltage on winding 18. In this manner, as the voltage applied to transformer T2 increases during the striking phase of lamp 12, VCO 38 will increase the frequency of the output circuit 24 to maintain the volt-second product through transformer T2 at a constant. When the voltage applied across T2 drops after lamp 12 is ignited, VCO 38 responds to the drop in voltage on monitor winding 18 by decreasing the frequency of operation of the output of circuit 24. In the illustrated embodiment, the output frequency of circuit 24 increases from a normal operating range of 240 Hz to 1200–1400 Hz during lamp ignition and returns to approximately 240 Hz after lamp ignition. After lamp ignition, the frequency of circuit 24 is maintained at a floor of about 240 Hz, even though the volt-second product will decrease below its predetermined value.

Figure 2:
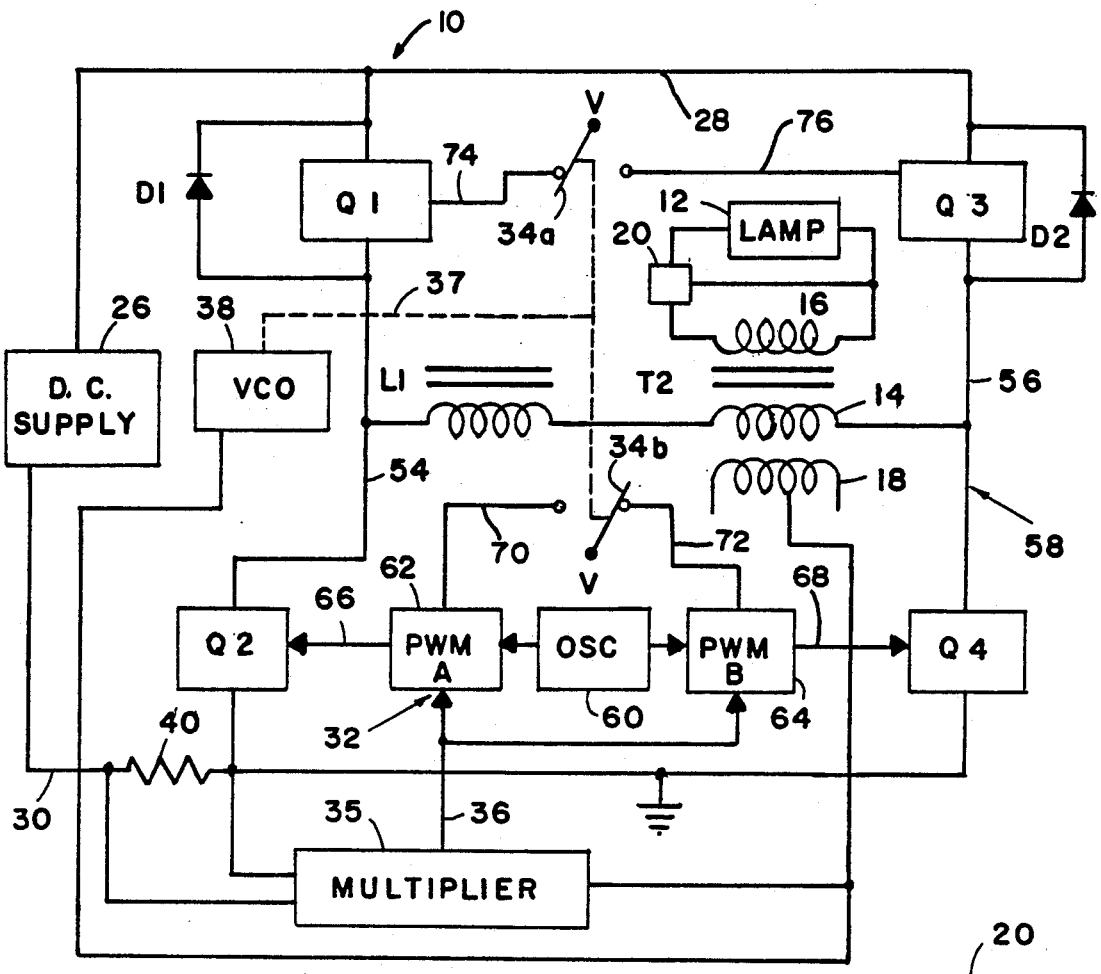
FIG. 2 is a circuit diagram of a preferred embodiment of the invention in block diagram form.

A preferred embodiment of the invention is illustrated in FIG. 2 as a switch-mode current regulating power supply. In this embodiment, primary winding 14 of transformer T2 is connected in series with a 1.6 milihenry inductor L1 across sides 54 and 56 of a bridge circuit 58. Bridge circuit 58 includes switches Q1 through Q4 with Q1 and Q2 in side 54 connected in series between voltage lines 28 and 30 and switches Q3 and Q connected in series between voltage lines 28 and 30 in side 56. In the illustrated embodiment, switches Q1 through Q4 are preferably power field effect transistors (FETs). A pulse-width modulating current source 32 includes a fixed-frequency oscillator 60 and a pair of pulse-width modulation circuits 62 and 64, which are operated at a constant frequency or pulse repetition rate by outputs from a fixed-frequency oscillator 60. Pulse-width modulation circuits 62 and 64 produce outputs on lines 66 and 68 which are connected, respectively, with the gating inputs of switches Q2 and Q4. Pulse-width modulation circuit 62 includes an enabling line 70 and will only produce pulses on line 66 when line 70 is connected with a voltage V. Pulse-width modulation circuit 64 includes an enabling line 72.

Variable frequency steering control 34 includes a first steering means **34*a* and a second steering means 34*b*, which are illustrated, for the purpose of explaining the operation of power source 10, as a double-pole-double-throw switch with steering means 34*a* alternatively connecting a voltage V between a gating input 74 of switch Q1 and a gating input 76 of Q3. Steering means 34*b* is illustrated as alternatingly connecting a voltage V between enabling inputs 70 of pulse-width modulation circuit 62 and 72 of pulse-width modulation circuit 64. As illustrated in FIG. 2, steering means 34*a* and 34*b* are coordinated such that means 34*a* is gating switch Q1 through line 74 at the same time that steering means 34*b* enables pulse-width modulation circuit 64 through enabling line 72. Periodically, voltage controlled oscillator 38 causes steering control 34 to reverse so that steering means 34*a* gates switch Q3 through line 76 and steering means 34*b* enables pulse-width modulation circuit 62 through enabling line 70**. It is thus seen that switches Q1 and Q4 operate in unison, albeit at different frequencies, and likewise, switches Q2 and Q3 operate in unison.

Oscillator 60 operates at a much higher frequency than the output of VCO 38; 20 kHz versus variable from 250 to 1400 Hz. Pulse-width modulation circuit 64, which is presently enabled by steering means **34*b*, modulates pulses initiated by oscillator 60 according to the value of the signal on line 36 which, as previously set forth, is proportional to the power being applied to lamp 12. Thus, with steering control 34 in the position illustrated in FIG. 2, switch Q1 will be conducting and switch Q4 will be switching off and on at a constant frequency with pulses modulated in width by circuit 64 in response to the power being applied to lamp 12**.

Multiplier 35, pulse-width modulation circuit 64 and switch Q4 provide a switch-mode current-regulated supply to lamp 12. The detailed operation of a switch-mode power supply is set forth in U.S. patent application Ser. No. 07/271,016 entitled INCANDESCENT LIGHT REGULATION AND INTENSITY CONTROLLER, filed Nov. 14, 1988 by inventor James C. Cook, II, a co-inventor of the present application and assigned to the assignee of the present invention and incorporated herein by reference. While the operation of a switch-mode power supply is set forth in detail in said application, suffice it to say that with Q1 and Q4 conducting, a current flows through inductor L1 and primary winding 14 from voltage lines 28 and 30. As the current increases, the signal on line 36 will increase in response to the product of the voltage sensed by monitor winding 18 and the current monitored across resistor 40. When the signal on line 36 reaches a predetermined level, pulse-width modulation circuit 64 removes the gating pulse from Q4, causing it to open. Q1 remains on, even when Q4 is not conducting as long as steering control 34 remains in the position illustrated in FIG. 2. Because energy is stored in inductor L1 and primary winding 14, current will continue to flow through Q1 via a circuit established by diode D2, which parallels switch Q3. As the current through L1 and T2 decays, the signal on line 36 from multiplier 38 decreases. Upon the occurrence of the next output pulse from oscillators 60, circuit 64 again gates switch Q4 on, which again establishes a path between voltage lines 28 and 30, which increases the current through inductor L1 and primary winding 14. The result is a relatively stable current through primary winding 14 of transformer T2 during the period that Q1 is conducting. When VCO 38 switches steering control 34 to the position opposite to that illustrated in FIG. 2, switch Q3 becomes conducting and switch Q2 is pulse-width-modulated by circuit 62, in the same manner described with respect to switch Q4, to establish a current through primary winding 14 in the direction opposite to that established when Q1 and Q4 are conducting. Whenever Q2 opens while Q3 is conducting, the current flowing through inductor L1 and primary winding 14 continues to flow through a circuit established through a diode D1 connected in parallel with switch Q1.

Thus it is seen that current is regulated by power source 10 according to the value of the signal on line 36, which is proportional to the power supplied to lamp 12, by modulating the width of pulses produced at a constant relatively high frequency and applied to either switch Q2 or Q4. The current so produced is alternatingly switched in direction through primary winding 14 by alternating the operation of switch pairs Q1 and Q4 with Q3 ad Q2 at a much slower frequency established by output 37 of voltage controlled oscillator 38. Thus, the magnitude of current supplied to lamp 12 is regulated in a manner to provide a constant power to lamp 12 and is alternatingly steered through primary winding 14 at a rate established by the voltage across transformer T2 in a manner that maintains a constant volt-second product across transformer T2 to avoid saturation of the transformer core.

Figure 3:
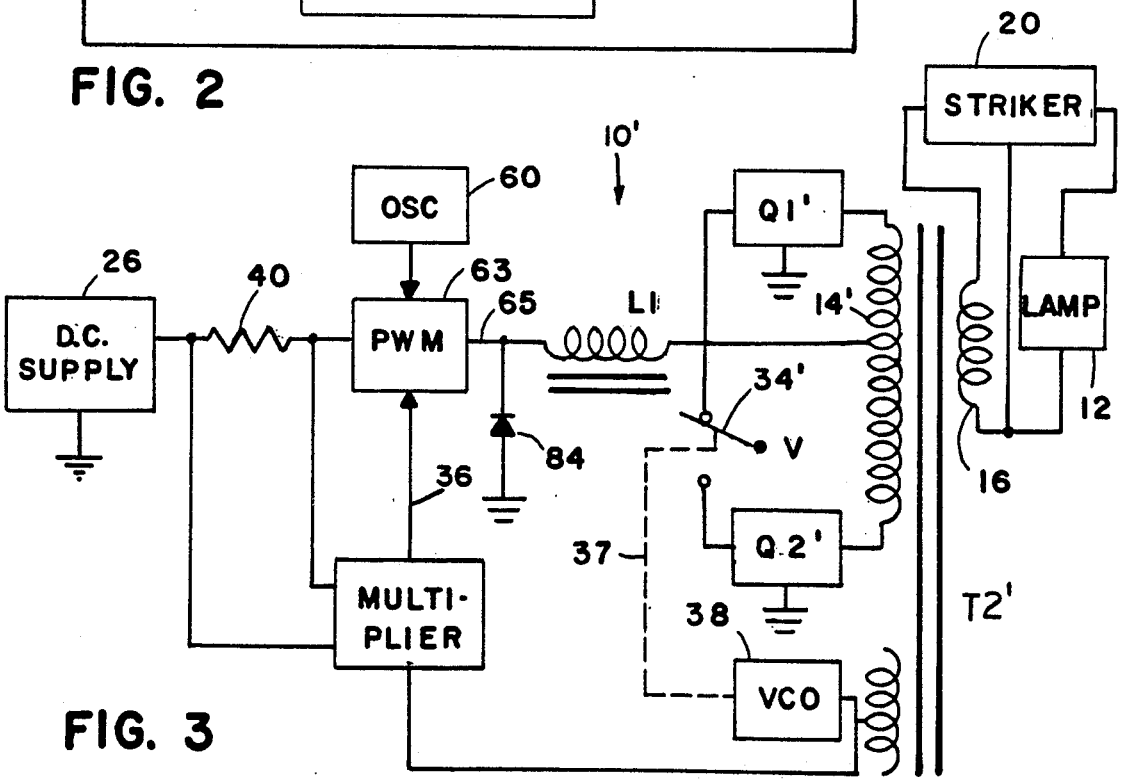
FIG. 3 is a circuit diagram of an alternative embodiment of the invention in block diagram form.

An alternative embodiment is illustrated in FIG. 3, which requires only one pulse-width modulation circuit, designated as 63, and two switches Q1′ and Q2′. In this embodiment, power source 10′ includes a single pulse-width modulation circuit 63 which produces modulated pulses clocked from oscillator 60 on a line 65 in response to the value of the signal on line 36. Line 65 is connected in series with inductor L1 to the center tap 78 of a primary winding 14′ of a transformer T2′. One end of primary winding 14′ is connected through switch Q1′ to steering control 34′. An opposite end of winding 14′ is connected through switch Q2′ to steering control 34′. Line 65 is connected with signal ground through a flyback diode 84. In this embodiment, current is regulated through L1 and one-half of the primary winding 14′ of transformer T2′ by pulse-width modulation control circuit 63 while the current is steered on one direction or the opposite direction through opposite halves of winding 14′ in response to the alternating switching of switches Q1′ and Q2′ by steering means 34′ at a frequency established by output 37 of VCO 38. Diode 84 provides a path for the current from L1 and winding 14′ between output pulses from circuit 63. The clearly apparent advantage of the circuit illustrated in FIG. 3 is a reduction in circuit components, particularly, only two power switches are required rather than four. However, FIG. 3 is not the preferred embodiment because the open circuit voltage that switches Q1 and Q2 may encounter are twice those in the embodiment illustrated in FIG. 2. This requires a more durable and costly switching FET for Q1 and Q2. Additionally, the embodiment illustrated in FIG. 3 requires a transformer T2' that is approximately 40% larger than T2 in FIG. 2 and is significantly more difficult to build.

Figure 4:
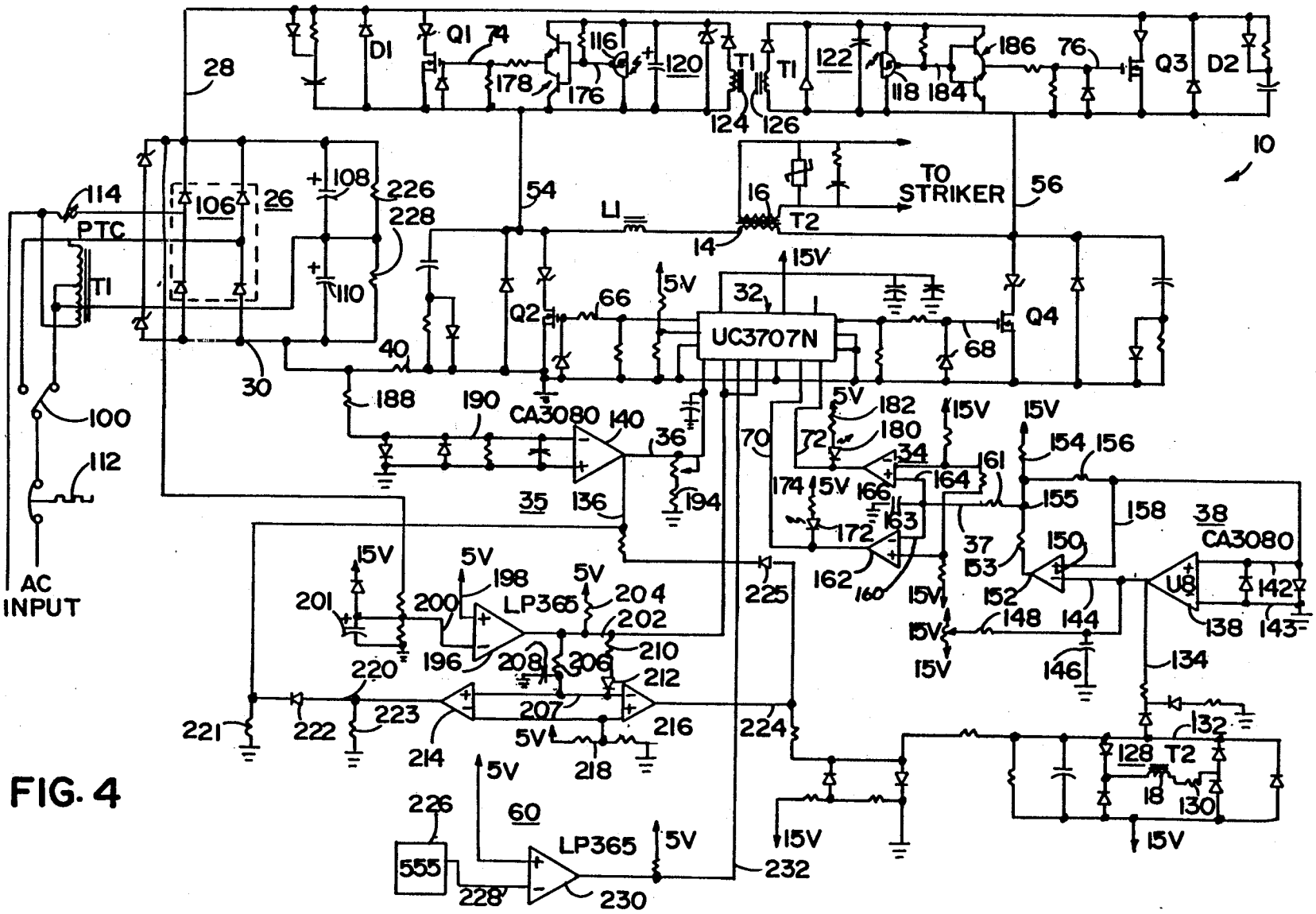
FIG. 4 is a circuit diagram of the preferred embodiment in FIG. 2 in schematic diagram form.

Referring to FIG. 4, DC power supply 26 is configured to provide nominal 330 volts DC, with little ripple, across lines 28 and 30 from either a 110 or 220 volt AC source. A selection switch 100 is selectively switchable such that a diode bridge 106 may be interconnected with input transformer T1 in alternative configurations. Capacitors 108 and 110 are connected across lines 26 and 30 in a manner that capacitors 108 and 110 double the rectified line voltage when switch 100 is in the position illustrated in FIG. 4. A nominal 330 VDC is produced across lines 28 and 30. Power is provided from the AC input through a thermal overload switch 112, which is in thermal engagement with transformer T2, to protect against temperature overload conditions, and through a positive temperature coefficient thermistor 114 to limit in-rush currents upon initial power-up of the circuit.

DC power line 28 is provided to power FETs Q1 and Q3, which are each gated from photoreceptors 116 and 118, respectively. Photoreceptors 116 and 118 receive DC power from a rectified AC power supply 120 and 122, respectively, supplied with AC power from supplemental windings 124 and 126, respectively, of transformer T1. Power FETs Q2 and Q4 are gated respectively from lines 66 and 68, which are output lines from a dual pulse-width modulation control circuit 32, which combines the functions of both pulse-width modulation circuits 62 and 64 in one package, and which is commercially available and sold by Unitrode Corporation under Part No. UC3707N. Monitor winding 18 of transformer T2 is connected with a full-wave rectifying bridge circuit 128 through a current limiting resistor 130. Bridge circuit 128 produces a filtered full wave rectified voltage on line 132, which is provided to the multiplying inputs 134 and 136, respectively, of transconductance amplifiers 138 and 140, respectively. Amplifier 138 additionally includes a non-inverting input 142 and inverting input 143 held in saturation. As a result, amplifier 138 produces an output current on line 144 having an amplitude that is equal to the current supplied on a multiplying input 134 and a polarity dependent upon the polarity of the signal on a line 158 provided to inputs 142 and 143. Output 144 is connected to the junction between a capacitor 146 and a resistor 148 and to the inverting input of a comparator 150. An output 152 of comparator 150, which is configured as an open collector transistor, is connected through pull-up resistors 153 and 154 to a positive voltage source. The junction 155 between resistors 153 and 154 is connected through a dropping resistor 156 to a non-inverting input 158 of comparator 150 and to input 142 of amplifier 138.

In this configuration, capacitor 146 is charged at a rate proportional to the voltage monitored by monitor winding 18 of transformer T2 and the resulting current provided to multiplying input 134 of amplifier 138. As the voltage across capacitor 146 rises, the output of comparator 150 eventually switches because line 158 is maintained within one diode-forward-voltage-drop above or below signal ground, which causes the inputs to amplifier 138 to reverse polarity. This causes capacitor 146 to discharge at the same rate that is proportional to the current on multiplying input 134, which will eventually cause comparator 150 to switch off. The faster the rate that capacitor 146 is charged and discharged by the current from output 144 of amplifier 138, the faster the rate of oscillation of voltage controlled oscillator 38. Because the rate of charge and discharge of capacitor 146 is equal to the current on multiplying input 134 of amplifier 138, the frequency of output 37 of VCO 38 is proportional to the voltage across transformer T2 because the current to multiplying input 134 is proportional to the voltage across monitor winding 18.

Line 37 is provided to the inverting input 160 of a comparator 162 and the non-inverting input 164 of a comparator 166. With the non-inverting input of comparator 162 and the inverting input of comparator 166 connected with fixed voltage levels, outputs 70 and 72 of comparators 162 and 166, respectively, alternatingly change states in response to the squarewave input from line 37. Output line 70 is connected with a light emitting diode (LED) 172 and through a pull-up resistor 174 to a voltage source. LED 172 is optically coupled with photoreceptor 116 such that the output 70 of comparator 162 switching to a high state causes photoreceptor 116 to produce a high state on line 176, which gates a transistor pair 178 to produce a gating pulse on line 74 for alternatingly causing FET Q1 to be gated on or off. Output 70 of comparator 162 is additionally provided to pin 15 of current source 32. Pin 15 is an enabling input which causes current source 32 to energize the pulse-width modulation circuit which is operative to produce a gating signal on line 68 to gate FET Q4.

Similarly, output 72 of comparator 166 is connected through an LED 180 and a pull-up resistor 182 to a positive voltage source. LED 180 is optically coupled with photoreceptor 118 such that output 72 of comparator 166 switching to a high state causes photoreceptor 118 to produce a high state on line 184, which is connected through a switching transistor pair 186 to the gating line 76 of FET Q3. Output line 72 of comparator 166 is additionally connected to pin 2 of current source 32, which responds to a signal on its pin 2 by enabling the pulse-width modulation circuit associated with FET Q2. Resistor 161, between junction 155 and line 37, in combination with capacitor 163, between line 37 and signal ground, provide a dead time between pulses on lines 70 and 72 to avoid the occurrence of overlap in energizing FETs Q1/Q4 with Q2/Q3.

Voltage line 30 is connected through a resistor 188 with the inverting input 190 of amplifier 140. Line 30 is on one terminal of resistor 40 whose opposite terminal is at signal ground level. The non-inverting input of amplifier 140 is likewise at signal ground. Therefore, the voltage across resistor 40, which has a low resistance sensing value such as 0.1 ohms, is provided across the inputs to amplifier 140. Amplifier 140 multiplies the value of the voltage across resistor 40 by the value of the current on its multiplying input 136, which is proportional to the voltage across winding 18 of transformer T2, to produce a current on line 36 that is a function of the power delivered to transformer T2 and hence to lamp 12. The current from output 36 is converted to a voltage by resistance network 194 and delivered to pin 9 of circuit 32. Circuit 32 responds to the level of the voltage delivered to its pin 9 from line 36 by pulse-width modulating a constant repetition rate clock signal inputted on its pin 3 from oscillator 60. A pulse-width modulated signal is delivered to either output pin 11 or 6 depending upon which "half" of circuit 32, i.e., which of two pulse-width modulation circuits, is enabled by enabling lines 70 and 72.

Output 70 from comparator 162 causes circuit 32 to produce modulated pulses on line 68 to switch Q4 while causing switch Q1 to be gated into a conducting state through LED 172 and photoreceptor 116. Likewise, output 72 from comparator 166 causes circuit 32 to produce modulated pulses on line 66 to switch Q2 while causing switch Q3 to be gated into a conducting state through LED 180 and photoreceptor 118. Thus, the alternating outputs 70 and 72 from comparators 162 and 166, respectively, reversingly steer the current through inductor L1 and primary winding 14 by alternatingly operating switches Q1 and Q3 while enabling opposite "halves" of circuit 32 at a rate established by VCO 38 in response to the voltage level across monitor winding 18 of transformer T2. The width of pulses produced on either line 66 or 68 is modulated by amplifier 140 as a product of the voltage across resistor 40 and the current into multiplying input 136, which is, most of the time, established by the voltage across monitor winding 18 of transformer T2.

A non-inverting input 198 of a comparator 196 is connected with a constant voltage source and an inverting input 200 is connected with voltage line 28 through suitably selected dividing resistors. The output of comparator 196 is provided on line 202, which is connected through a pull-up resistor 204 to a positive voltage source and to input pins 1 and 16 of circuits 32. Pins 1 and 16 are enabling pins which disable the entire circuit 32 unless provided with a low voltage level. Line 202 is additionally connected through a resistor 206 and through a series combination of a resistor 210 and forwardly-poled diode 212 to a junction 207. Junction 207 is additionally connected to signal ground through a capacitor 208, to the non-inverting input of a comparator 214 and to the inverting input of a comparator 216. The inverting input of comparator 214 is connected with the non-inverting input of comparator 216 and with a junction 218 maintained at a constant voltage. An output 220 of comparator 214 is connected through a forwardly-poled diode 222 to multiplying input 136 of amplifier 140. An output 224 of comparator 216 is connected with line 132.

Upon application of power to the circuit, output 202 of comparator 196 will initially be open-circuited. This will cause output line 202 to be pulled to a high level through pull-up resistor 204 and disable circuit 24 so that the voltages throughout power supply 10 may stabilize. The positive level of output line 202 will rapidly charge capacitor 208 through resistor 210 and forward-biased diode 212. As the voltage across DC lines 28 and 30 rises in response to capacitors 108 and 110 charging, input 200 will rapidly become greater than input 198, which will cause comparator 196 to switch its output to a conducting stage. This will cause line 202 to switch to a low state which enables circuit 24 to operate.

When line 202 drops to a low level, capacitor 208 will begin to discharge through resistor 206, but at a slower rate than it was charged. It cannot discharge through resistor 210 because diode 212 will be reverse-biased. The voltage across capacitor 208 will cause open-collector output 224 of comparator 216 to be driven to the −15 volt supply for comparator 216 and the open-collector output 220 of comparator 214 to be in an open condition. With output line 224 clamped to −15 volts, diode 225 is reverse-biased. With output 220 open-circuited, resistors 221 and 223 will solely determine the input current supplied on line 136. During lamp startup, no current flows to the lamp initially. Circuit 32 responds by increasing the voltage to the lamp which will eventually cause striking to occur. With diode 225 reverse-biased, the voltage signal from monitor winding 18 does not influence amplifier 140. Once current begins to flow to the lamp, a fixed output from amplifier 140 causes circuit 32 to modulate pulse width in a manner that induces a fixed current flow to the lamp irrespective of its voltage.

As the voltage across capacitor 208 continues to discharge through resistor 206, the voltage on junction 207 will eventually drop below that on 218. This will cause line 220 to go to the −15 volt supply for comparator 214 and the output 224 of comparator 216 to switch to an open circuit condition. With line 220 at −15 volts, diode 222 is reverse-biased, which isolates resistor 223 from the circuit. Resistor 221 has a sufficiently high value to be insignificant. The open condition of line 224 allows multiplying input line 136 to receive a current from line 132 that is proportional to the voltage across monitor winding 18 which controls, in combination with input line 190, the width of pulses produced by circuit 32.

Oscillator 60 includes a type 555 oscillating circuit 226 configured to provide a 20 kHz pulse train on line 228. Line 228 is provided as an input to a comparator 230 whose opposite input is held at a constant level to provide inverting and conditioning of the output from the oscillator for presentation on line 232 to pin 3 of circuit 32.

Various diodes, capacitors and resistors are illustrated in FIG. 4 for the purposes of providing protection to sensitive electronic components in a manner that will be readily understood by one skilled in the art.

Changes and modifications in these specifically described embodiments can be carried out without departing from the principles of the invention. For example, the invention, although illustrated in a hybrid circuit including both analog and digital components, may be readily adapted to substantially full digital implementation by a microprocessor. The protection afforded the invention is intended to be limited only by the scope of the appended claims, as interpreted according to the principles of patent law including the doctrine of equivalents.

The embodiments of the invention in which an exclusive property or privilege is claimed are defined as follows:

1. A power supply for a gas discharge lamp comprising:

power source means for supplying power;

a transformer having a primary winding and a secondary winding, said secondary winding adapted to supply power to a discharge lamp;

current regulation and steering means for regulating the current supplied to the discharge lamp from said power source and for steering current from said power source through said primary winding in alternating direction;

said current regulation and steering means being responsive to the voltage across said transformer windings for switching the direction of current through said primary in a manner to maintain a predetermined volt-second product across said transformer windings;

said current regulation and steering means is responsive to the current supplied to the discharge lamp and the voltage across the lamp for maintaining a constant power level to the lamp.

2. The power supply in claim 1 in which said current regulation and steering means includes switch means between said power source and said primary winding for interrupting current to the lamp and regulating means for closing said switch means at a predetermined repetition rate and for opening said switch means in response to the current supplied to the lamp.

3. The power supply in claim 2 in which said regulating means opens said switch means in response to the product of the current through the lamp and the voltage across the lamp.

4. The power supply in claim 1 in which said current regulating and steering means includes current reversing switch means operable for reversing the direction of current through said primary winding and oscillating means for operating said switch means at a particular frequency determined by the voltage across a transformer winding.

5. A power supply for a gas discharge lamp comprising:

a power source means for supplying power;

a transformer having a primary winding and a secondary winding, said secondary winding adapted to supply power to a discharge lamp;

current source means for regulating the current supplied to the discharge lamp from said power source; and means for regulating the volt-second product of said transformer in a manner to maintain a substantially constant volt-second product not withstanding changes in the voltage across said transformer windings;

said volt-second product regulating means includes means responsive to the voltage supplied across said transformer windings for varying the frequency of said voltage supplied across said transformer;

said current source means is responsive to the current supplied to the discharge lamp and the voltage across the lamp for maintaining a constant power level to the lamp.

6. The power supply in claim 5 in which said current source means includes switch means between said power source and said primary winding for interrupting current to the lamp and means for closing said switch means at a predetermined repetition rate and for opening said switch means in response to the current supplied to the lamp.

7. The power supply in claim 6 in which said switch means is opened in response to the product of the current through the lamp and the voltage across the lamp.

8. A power supply for a gas discharge lamp comprising:

a power source means for supplying power;

a transformer having a primary winding and a secondary winding, said secondary winding adapted to supply power to a discharge lamp;

current source means connected with said primary winding for regulating the current supplied to the discharge lamp from said power source; and switch means connected with opposite ends of said primary winding for causing current to flow through said primary winding from said current source means and gating means for alternatingly causing said switch means to conduct in order to alternate the direction of current flow through said primary winding;

said power supply further including means responsive to the voltage supplied across said transformer windings for varying the frequency of alternation of said gating means;

said current source means is responsive to the current supplied to the discharge lamp and the voltage across the lamp for maintaining a constant power level to the lamp.

9. The power supply in claim 8 in which said current source means includes means for supplying current pulses and for modulating the width of pulses as a function of the current supplied to the lamp and further includes an inductor in series with said primary winding.

10. The power supply in claim 9 in which said means for supplying current pulses includes means for modulating the width of pulses as a function of product of the current supplied to the lamp and the voltage across the lamp.

11. A power supply for a gas discharge lamp comprising:

a power source means for supplying power at output terminals thereof;

a transformer having a primary winding and a secondary winding, said secondary winding adapted to supply power to a discharge lamp;

a bridge circuit including first and second sides extending between said power source terminals, each of said sides having first and second legs joined at a junction, said bridge circuit further including a series circuit extending between said junctions, said primary winding being in said series circuit, and switch means in each of said legs for conducting a current in response to a gating signal;

first current regulating means capable of being enabled for supplying gating signals to said switch means in said first leg of said first side;

second current regulating means capable of being enabled for supplying gating signals to said switch means in said first leg of said second side; and current steering means alternatable between first and second states for gating said switch means in said second leg of said first side and enabling said second current regulating means in said first state and for gating said switch means in said second leg of said second side and enabling said first current regulating means in said second state.

12. The power supply in claim 11 further including voltage monitoring means for monitoring the voltage across said transformer windings and oscillation means responsive to said voltage monitoring means for producing a cyclical signal varying in frequency in proportion to said voltage across said transformer windings, and in which said current steering means is responsive to said cyclical signal and alternates between said states at said frequency of said cyclical signal.

13. The power supply in claim 12 further including current monitoring means for monitoring the current supplied to a discharge lamp and in which each of said current regulating means is responsive to said current monitoring means for supplying gating signals in a manner that is a function of said current supplied to said lamp.

14. The power supply in claim 13 in which each of said current regulating means is also responsive to said voltage monitoring means for supplying gating signals in a manner that is a function of said voltage across said transformer windings.

15. The power supply in claim 12 in which said voltage monitoring means includes a third winding of said transformer and means for monitoring the voltage across said third winding.

16. The power supply in claim 14 further including means responsive to said voltage monitoring means and said current monitoring means for producing a signal that represents the product of the value of said voltage across said transformer windings and the value of said current supplied to said lamp, said current regulating means being responsive to said transconductance means signal.

17. The power supply in claim 11 further including an inductor in said series circuit, said inductor being in series with said primary winding.

* * * * *